US009066632B2

(12) United States Patent
Millerd

(10) Patent No.: US 9,066,632 B2
(45) Date of Patent: Jun. 30, 2015

(54) PORTABLE WALK-IN BATHTUB

(76) Inventor: Chet Millerd, Temecula, CA (US)

( * ) Notice: Subject to any disclaimer, the term of this patent is extended or adjusted under 35 U.S.C. 154(b) by 843 days.

(21) Appl. No.: 13/253,737

(22) Filed: Oct. 5, 2011

(65) Prior Publication Data

US 2013/0086738 A1 Apr. 11, 2013

(51) Int. Cl.
*A47K 3/02* (2006.01)
*A47K 3/00* (2006.01)

(52) U.S. Cl.
CPC .. *A47K 3/02* (2013.01); *A47K 3/006* (2013.01)

(58) Field of Classification Search
CPC ..... A47K 3/006
USPC ..... 4/538–595
See application file for complete search history.

(56) References Cited

U.S. PATENT DOCUMENTS

| | | | | | |
|---|---|---|---|---|---|
| 1,710 | A | | 7/1840 | Warren, Jr. | |
| 248,790 | A | | 10/1881 | Prewitt | |
| 1,008,957 | A | * | 11/1911 | Cox | 4/599 |
| 1,377,803 | A | * | 5/1921 | Bush | 126/377.1 |
| 1,450,444 | A | | 4/1923 | McGuire | |
| 1,663,735 | A | * | 3/1928 | Talbot et al. | 4/599 |
| 3,010,116 | A | | 11/1961 | Cowley | |
| 3,157,774 | A | * | 11/1964 | Moore et al. | 392/444 |
| 3,467,968 | A | * | 9/1969 | Tatii | 4/525 |
| 4,305,165 | A | | 12/1981 | Wall, Jr. | |
| 4,680,817 | A | * | 7/1987 | Sloan et al. | 4/663 |
| 4,777,675 | A | * | 10/1988 | Letner | 4/599 |
| 4,796,312 | A | * | 1/1989 | Corlew | 4/555 |
| 5,025,515 | A | * | 6/1991 | Rhines | 4/585 |
| 5,136,735 | A | * | 8/1992 | Zimmerman | 4/597 |
| 5,255,400 | A | * | 10/1993 | Sween | 4/556 |
| 5,598,590 | A | | 2/1997 | Crawford et al. | |
| 5,666,677 | A | | 9/1997 | Crawford et al. | |
| 5,926,866 | A | * | 7/1999 | Chao | 4/572.1 |
| 5,940,902 | A | * | 8/1999 | Onge et al. | 4/555 |
| 5,978,983 | A | * | 11/1999 | Queen et al. | 4/556 |
| 6,088,848 | A | | 7/2000 | Waterlyn | |
| 6,775,861 | B1 | * | 8/2004 | Devereaux et al. | 4/538 |
| 2004/0078887 | A1 | * | 4/2004 | Kuntz | 4/556 |
| 2005/0102746 | A1 | * | 5/2005 | Wright et al. | 4/555 |
| 2010/0275364 | A1 | | 11/2010 | Torres et al. | |

OTHER PUBLICATIONS

Ability Tubs, LLC, "Walk-in Tubs", http://www.abilitytubs.com/walkins.php [retrieved from Internet on Nov. 2, 2011], 2 pages.
"Portable Walk In Tub", http://portablewalkinbath.com/portable-walk-in-tub [retrieved from Internet on Nov. 2, 2011], 2 pages.

* cited by examiner

*Primary Examiner* — Lori Baker
(74) *Attorney, Agent, or Firm* — McKee, Voorhees & Sease, PLC

(57) ABSTRACT

A portable, walk in type bathtub includes an entrance and a door attached thereto to allow someone to walk into the bathtub without stepping over a wall. A replaceable water tank is attached to the tub such that clean water is directed from the water tank to the tub. Once the water has been used, the dirty or black water is directed to a separate tank within the water tank attachment. Once all of the clean water from the water tank has been used, the water tank is detached from the tub housing and a new tank containing clean water is attached to the tub to further facilitate bathing. The tub and water tank include wheels attached to the bottoms thereof to facilitate movement of the tub and water tank. The wheels may be raised and lowered to facilitate movement and locking of the tub in place.

20 Claims, 5 Drawing Sheets

PORTABLE WALK-IN BATHTUB

FIELD OF THE INVENTION

The present invention relates generally to portable bathtubs. More specifically, but not exclusively, the invention relates to portable walk-in type bathtubs featuring a walk-in entrance and a door to provide access into the bathtub.

BACKGROUND OF THE INVENTION

Personal hygiene is important to people. It is especially a concern in situations where people do not have access to permanent bath or shower facilities. For instance, after national disasters, such as earthquakes, tornadoes, floods, hurricanes, etc., many people are left without water and electricity, therefore making it difficult for the people to find a place to take a bath or clean any of their belongings. In the alternative, health problems make it difficult for some people to bathe or shower. As most common bathtubs have a wall to climb over, and walk-in showers require people to stand, health problems may prevent the people from taking a bath or shower. When the health issue is temporary, it would be too expensive to replace their baths or showers with permanent walk-in type bathtubs. Therefore, it would be beneficial for the injured or recovering individual to have access to a bathtub with an easy entrance, while not having to pay the expenses of completely renovating their bathroom.

Portable bathtubs have been around for some time. The portable tubs have generally included wheels, or castors, attached to the bottom of the tubs to provide for simplified moving of the bathtubs from one location to another. The tubs generally consist of two types: having a refillable tank for storing water; or being connected to an external source of water. The former variety includes holding tanks being part of the bathtub that are filled with water from an external source. For instance, a water truck or other source of water may fill the tanks. When the water from the truck or other source runs out, the bathtubs may not be used. In addition, when the portable tub is used inside of a building, it is difficult to fill the permanent container.

Bathtubs connected to an external source of water include hoses or other means of connecting the tubs to external sources of water. For instance, hoses may be used to connect the portable bathtubs to a faucet within a building, or a hose hookup outside of a building. In either case, the bathtub requires a connection to some source of running water. When a disaster or other situation occurs that contaminates or stops the running water, the bathtubs may not be used, as they do not have a viable water source to fill the tubs.

Therefore, there is a need in the art for a portable, walk-in type bathtub that can be used without having to permanently replace a tub in a bathroom, and that can be refilled without the use of running water connections or another source of water to fill up a permanent tank built into the bathtub.

It is therefore a primary object, feature, and/or advantage of the present invention to overcome deficiencies in the art.

It is another object, feature, and/or advantage of the present invention to provide an improved portable bathtub that allows a person to walk in to the tub through an entrance.

It is yet another object, feature, and/or advantage of the present invention to provide a portable bathtub that can be used in times of emergency.

It is still another object, feature, and/or advantage of the present invention to provide an improved portable bathtub that can be temporarily used by people with health conditions.

It is yet another object, feature, and/or advantage of the present invention to provide an improved portable bathtub that includes a removable water compartment that can be easily attached and detached from the bathtub.

It is yet a further object, feature, and/or advantage of the present invention to provide an improved portable bathtub having a detachable water compartment with a clean water ballast and a gray water ballast.

It is still a further object, feature, and/or advantage of the present invention to provide an improved portable bathtub that includes a tankless water heater to warm the water.

These and/or other objects, features, and advantages of the present invention will be apparent to those skilled in the art. The present invention is not to be limited to or by these objects, features and advantages. No single embodiment need provide each and every object, feature, or advantage.

SUMMARY OF THE INVENTION

According to one aspect of the present invention, a portable, walk-in type bathtub is provided. The bathtub includes a bathtub housing having an entrance for providing access to an interior of the housing. A plurality of wheels is attached to a bottom of the housing. A water compartment is operably attached to the housing, with the compartment comprising a first ballast for holding clean water and a second ballast for holding gray water. A pump is operatively connected to the water compartment for pumping water between the bathtub housing and the water compartment.

According to another aspect of the present invention, a portable, walk-in type bathtub is provided. The bathtub includes a housing comprising an inner wall defining an interior, an outer wall spaced away from the inner wall, and an entrance through the outer and inner wall for providing access to the interior of the housing. The inner and outer walls of the housing are connected at a top and a bottom of the housing. A door is positioned at the entrance of the housing. A plurality of wheels is positioned at the bottom of the housing. A removable water compartment is operably attached to the bathtub housing, the water compartment comprising a first ballast for holding clean water and a second ballast for holding gray water. A pump is operatively connected to the water compartment for pumping water between the bathtub housing and the water compartment.

According to yet another aspect of the present invention, a method of providing a bath is provided. The method includes the step of taking a bathtub housing having an interior. A removable water compartment is attached to the housing, with the compartment having a first ballast and a second ballast. The interior of the bathtub housing is filled with water from the first ballast. Water is drained from the interior of the bathtub housing to the second ballast.

DETAILED DESCRIPTION OF THE PREFERRED EMBODIMENTS

Figure 1:
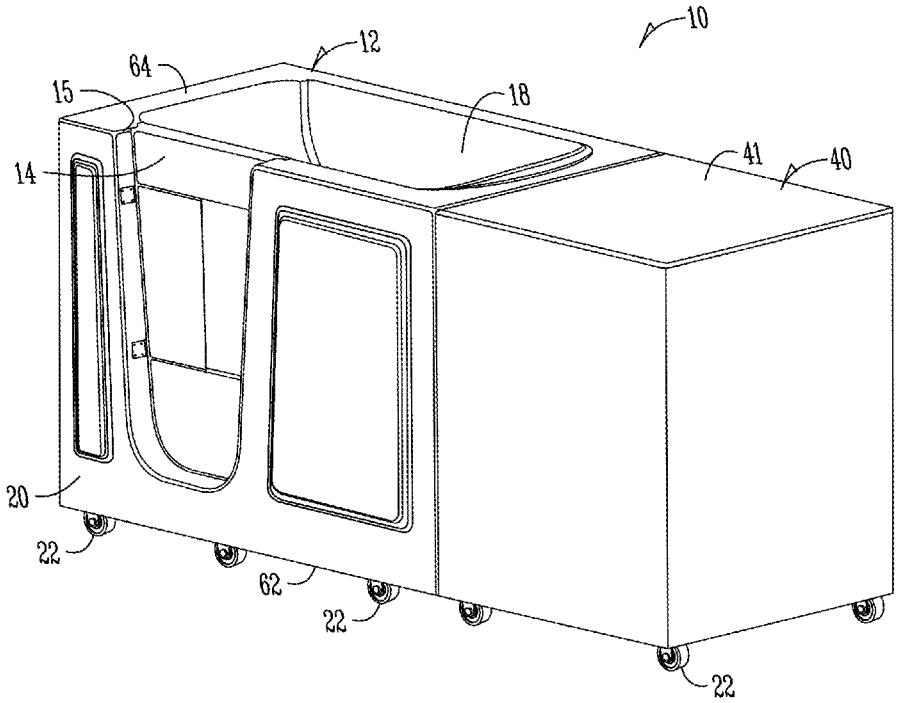
FIG. 1 is a perspective view of an exemplary portable bathtub of the present invention.

FIG. 1 shows a perspective view of a portable bathtub 10 according to the present invention. The portable bathtub 10 shown in FIG. 1 is a walk in type bathtub having an entrance 15 to a housing 12. The entrance 15 is closed off by a door 14 attached to the housing 12. Preferably, the housing 12 comprises a fiberglass shell that is made of sheets of fiberglass lying on top of one another and finished with a gel coating. The door 14 is also comprised of the fiberglass material and is hingeably attached to the housing 12. The door also includes a seal (not shown) to ensure that water inside the housing 12 of the bathtub 10 does not leak or otherwise disperse through the entrance 15 when the door is closed. The housing has an interior wall 18 and an exterior wall 20, which are connected at the top 64 and the bottom 62 of the housing. In the interior of the housing 12 are a seat 16 and a slip resistant floor 17.

Shown in FIG. 1 attached to the housing 12 is a detachable water tank attachment 40. The water tank attachment 40 provides a removable water supply that may be attached to the housing 12 of the portable tub 10 such that the tub is used without the need of a permanent water source. Therefore, the portable tub 10 may be used in areas that have experienced natural disasters or as a temporary bathtub for people having health conditions that do not allow them to climb over a standard tub wall. The water tank attachment 40 is also preferably comprised of fiberglass, similarly to the bathtub housing 12.

The portability of the tub 10 is further enhanced by the inclusion of a plurality of wheels 22 positioned on the bottom 62 of the tub housing 12 and the water tank attachment 40. The wheels are casters that can be lowered and raised relative to the ground to move the bathtub to different locations. When the wheels are raised, the bathtub will be locked temporarily in place such that the bathtub will not roll away from its intended location. Furthermore, as shown in FIG. 1, the water tank attachment includes a water tank lid 41 covering a clean water tank or ballast 42 and a black or gray water tank or ballast 44. For purposes of the present invention, the used water of the bathtub may be referred to as "black water" or "gray water." The clean water tank 42 may also be called a first ballast, and the black water tank 44 may be known as a second ballast.

Figure 2:
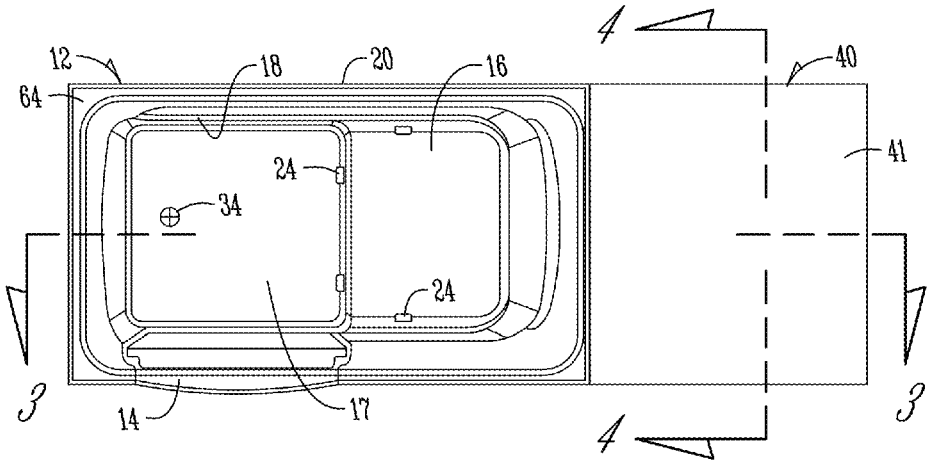
FIG. 2 is a top view of the portable bathtub of FIG. 1.

FIG. 2 is a top view of the portable bathtub 10 of FIG. 1. FIG. 2 further shows the interior of the tub housing 12, including the seat 16, floor 17, interior wall 18, jet system or plurality of jets 24, and drain 34. The door 14 at the entrance 15 of the housing 12 includes a lock (not shown) and a door drain. The lock works with the seal to ensure that the door will not open when the housing 12 of the bathtub 10 is filled with water. The door drain works along with the drain 34 of the housing to speed up drainage of the water from the bathtub housing 12. As shown in FIG. 2, the interior of the housing 12 includes a plurality of jets 24 positioned throughout the interior. For instance, the jets may be located around the seat 16, as well as below the seat adjacent the floor 17 of the housing 12. The jets 24, which may also be nozzles, are used to fill the interior of the housing 12 with water from the clean water tank 42 of the water tank attachment 40. The jets may also be used to massage, circulate, or otherwise provide comfort to a user of the portable tub 10. One example of a jet system that may be used with the portable tub 10 of the present invention may be purchased from Sanijet, 6200 Maple Avenue, Dallas, Tex. However, it should be appreciated that other models and manufacturers of jets may be used with the present invention. The present invention is not limited to one type of jet system.

Figure 3:
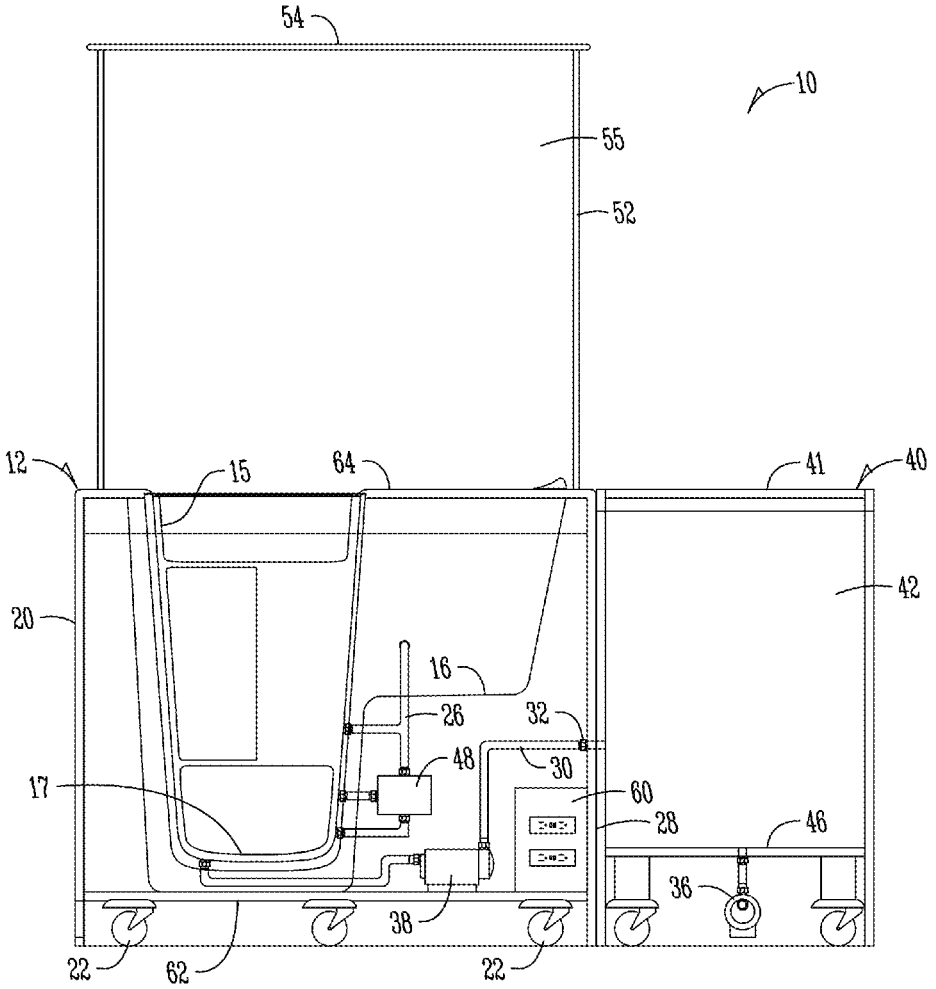
FIG. 3 is a front sectional view of the portable bathtub of FIG. 2 according to line 3-3.

FIG. 3 is a side sectional view of the portable tub of FIG. 2 along the line 3-3 of FIG. 2. FIG. 3 shows parts of the interior of the walls of the tub housing 12 and the water tank attachment 40. For instance, FIG. 3 shows the inlet pipes 26 and outlet pipes 30 of the portable tub 10. The inlet pipes 26 are connected to a clean water pump 36 in the clean water tank 42 of the water tank attachment 40. The inlet pipes connect to more inlet pipes 26 between the interior wall 18 and the exterior wall 20 of the tub housing 12. The pipes of the water tank 40 and the housing 12 may be connected by a quick connect attachment or connector. The quick connector 28 should be sufficient to connect the pipes so they will not leak. However, the quick connection at the inlet 28 should allow an operator to quickly disconnect the pipes such that a new water tank attachment 40 containing a new tank of clean water in the clean water tank 42 may replace the previous water tank attachment 40. The inlet pipes further connect to a circulating water heater 48. The circulating water heater 48 includes pipes that are further extended to the jets 24. Therefore, the water in the interior of the housing 12 may be circulated through the jet system and through the water heater 48 to maintain the temperature of the water in the tub at a sufficient or predetermined temperature.

FIG. 3 also shows the drainage or outlet pipes 30 of the portable tub 10. The outlet pipes are connected to a drain 34 in the floor 17 of the tub housing 12. The pipes are connected to a black or dirty water pump 38, which aids in draining the water from the interior of the housing. The pump further directs the water through an outlet connection 32, which may also be known as a second attachment. The outlet connection 32, similarly to the inlet connection 28, is a quick connect pipe fitting to connect the outlet pipes 30 to the black water tank 44 of the water tank attachment 40. The outlet connection 32 should be quickly connectable and disconnectable such that the water tank attachment 40 may be replaced when the clean water has been used and the black water tank 44 is full.

Further shown in FIG. 3 is a telescoping shower post 52. The telescoping shower post 52 includes four posts located at the corners of the top 64 of the housing 12. The posts 52 are telescoped from an area within the housing 12 between the interior wall 18 and the exterior wall 20. While four telescoping shower posts 52 are shown in the present invention, it should be appreciated that fewer or a greater number of posts 52 may be used to support a shower pole and curtain, as needed. Connected to the top of the shower post 52 is a shower pole 54. The shower pole 54 is connected to each of the shower posts and is generally aligned with the periphery of the tub housing 12. Connected to the shower pole 54 and extending downwardly is a shower curtain 55. The shower curtain 55 is connected to the shower pole 54 such that the curtain 55 will rise with the shower pole when the telescoping posts 52 are raised. Therefore, the portable bathtub 10 may be converted into a portable shower. In such case, an extendable showerhead (not shown) may be included to the interior of the housing 12 such that a user may stand and shower within the tub, while still maintaining privacy.

A power inverter 60 is also shown in FIG. 3. The power inverter 60 may connect the power supply 50 to the pumps, heater and optional temperature control (not shown) of the portable tub 10. The power inverter 60, inlet pipes 26, outlet pipes 30, heater 48, and black water pump 38 are all located between the interior wall 18 and the exterior wall 20 of the housing. Furthermore, the pumps, heater, inverter, and pipes may be accessible through the walls of the housing 12 by the use of easy access panels (not shown). The panels may be removed to allow access to the area between the interior wall 18 and the exterior wall 20 of the housing 12, while still being sealably shut such that water is not able to leak into the area between the interior and exterior walls of the housing.

Figure 4:
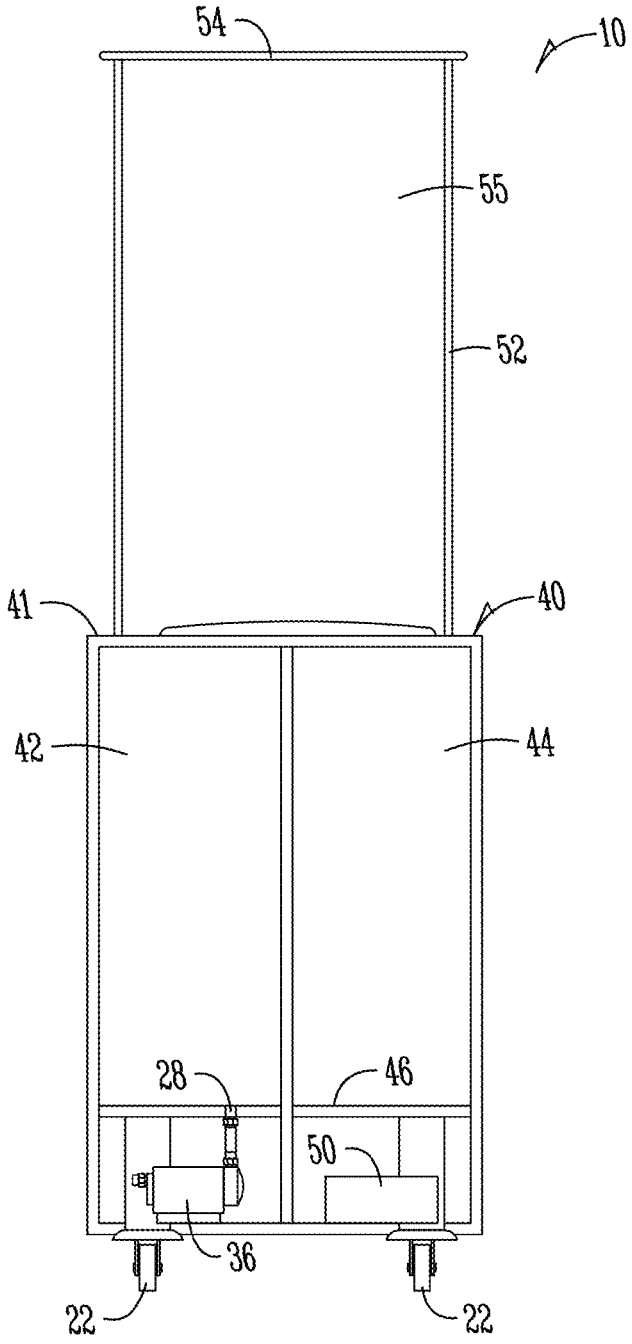
FIG. 4 is an end sectional view of the portable bathtub of FIG. 2 according to line 4-4.

FIG. 4 is an end sectional view of the bathtub of FIG. 2 taken along line 4-4 of FIG. 2. FIG. 4 is an end view showing the interior of the water tank attachment 40. As mentioned previously, the interior of the water tank attachment 40 includes a clean water tank 42 and a separate black water tank 44. The clean water tank may be a ballast containing unused, treated, or other water, which has not been used to cleanse another person. The black water tank 44 may include a second ballast, which is used to receive water, which has been used to clean or bathe a user of the portable tub 10. A lid 41 encloses the top of the water tank attachment. Also included within the attachment 40 in both the clean water tank 42 and black water tank 44 is a shelf 46. The shelf 46 separates the water in the tanks from an area below the shelf. As shown in FIG. 4, the shelf 46 in the clean water tank 42 separates the water from the clean water pump 46. The shelf 46 in the black water tank 44 separates the water or ballast from a power supply 50. The power supply may be one or a plurality of batteries that is connected to the power inverter 60. Furthermore, while a shelf 46 is shown in the clean water tank 42, it may not be necessary such that the clean water in the tank may surround the clean water pump 36.

Also shown in FIG. 4 is a plurality of wheels 22 on the bottom of the water tank attachment 40. Also discussed above, multiple telescoping shower posts 52 are extending generally upwardly from the portable tub 10. The shower posts 52 are connected at the top by a shower pole 54. As also discussed above, a shower curtain extends generally downwardly from the shower pole 54 and between the two shower posts 52 and generally extends from one shower post to the other.

Figure 5:
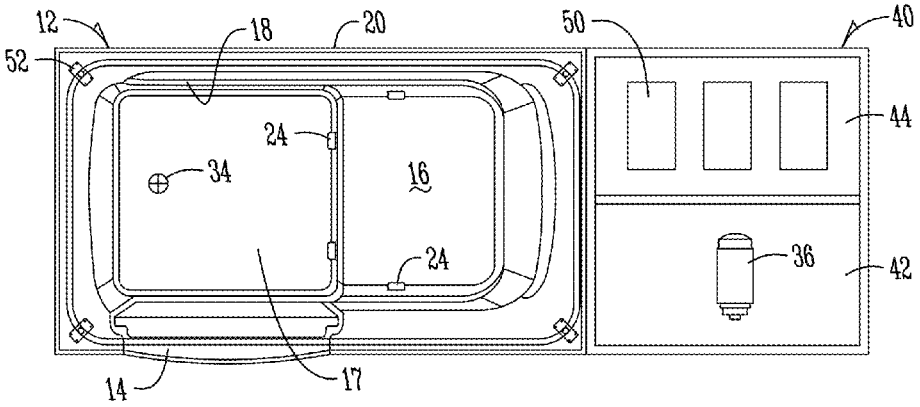
FIG. 5 is a top view of the portable bathtub of FIG. 1 with the lid and shelf removed from the water tank attachment.

FIG. 5 is a top view of the portable bathtub 10 of FIG. 1 with the water tank lid 41 and the water tank shelf 46 removed from the water tank attachment 40. Thus, one is able to view the full interior of the water tank attachment 40. As discussed in relation to FIG. 4, the battery packs 50 are placed under the shelf 46 in the black water tank 44 of the water tank attachment 40. As the water tank attachment 40 is replaced when the water in the clean water tank has all been used up, a new set of batteries 50 will be connected to the portable tub 10 when the water tank attachment is replaced. A plug in or other electrical connection may be used between the water tank attachment 40 and a portion of the housing 12. For instance, a plug in may extend from the power supply 50 (plurality of battery packs) to the power inverter 60 housed within the interior and exterior walls of the housing 12. Furthermore, the power inverter may be a 3000-watt power inverter with a ground fault circuit interrupter (GFCI) breaker located thereon. Therefore, an electrical wire having a male plug in may extend from the power supply or tank attachment to the power inverter and plug into the female receptacles of the power inverter at the GFCI to provide power to the portable tub 10. This portable power system negates the need for any permanent power source, which further increases the possibilities for use of the portable bathtub 10. For example, when the tub or a plurality of tubs are used in areas affected by a natural disaster, other sources of power may be used for cooking food, providing light, and other clean up, while the portable power supply in the water tank attachment 40 may be used to power the portable bathtubs 10.

Other options may be added to the portable tub 10 as needed. For instance, a grab bar may be included to the interior wall 18 of the portable tub 10 to aid in seating and standing from the seat 16 within the tub. Furthermore, a hydro or air jetted system (or combination of both) with rigid PVC piping may be used within the housing 12 of the tub. As discussed above, when the Sanijet system is used with the portable tub 10, piping will not be required as the Sanijet jets are pipe free. Cushions may be added to the seat and interior wall around the seat of the housing 12 of the portable tub 10. Furthermore, an aromatherapy system may be included, a UV purification system may be included, and chrome fixtures, anti-scalding valve, massage systems, or ozone purification systems may also be incorporated within the housing 12 of the portable tub 10. In addition, an electronic control panel (not shown) may be included and connected to the water heater to adjust the temperature of the water in the portable tub, as well as the amount of flow into the tub. The amount of flow may be adjusted to adjust the amount of water within the tub to accommodate both children and adults of different sizes. The control panel may also be used to adjust the other optional components of the tub.

The general description of the present invention as well as the preferred embodiment of the present invention has been set forth above. Those skilled in the art to which the present invention pertains will recognize and be able to practice additional variations in the methods and systems described which fall within the teachings of this invention. For instance, variations in the size, shape, and capacity of the water tank attachment may be varied according to different sizes of tubs and situations. Furthermore, the amount of jets and method of filling the bathtub may also be varied. Accordingly, all such modifications and additions are deemed to be within the scope of the invention, which is to be limited only by the claims appended hereto.

What is claimed is:

1. A portable, walk-in type bathtub, comprising:

a bathtub housing having an entrance for providing access to an interior of the housing;

a plurality of wheels attached to a bottom of the housing;

a water compartment removably attached to the bathtub housing, the water compartment comprising a first ballast for holding clean water for use with the bathtub and a second ballast for holding gray water that has been used in the bathtub; and a pump operatively connected to the water compartment for pumping water between the bathtub housing and the water compartment;

said bathtub housing and water compartment forming a substantially integral unit when attached such that the housing and compartment movable as a substantially singular unit; and said pump configured to pump clean water from the first ballast of the integral water compartment to the bathtub for use by a user in the bathtub.

2. The bathtub of claim 1 further comprising a door at the entrance of the housing.

3. The bathtub of claim 2 further comprising a water heater positioned within the housing and operably connected to the water compartment for selectively heating the clean water.

4. The bathtub of claim 3 wherein the water heater is a tankless water heater.

5. The bathtub of claim 3 wherein the pump is an electric pump.

6. The bathtub of claim 5 further comprising a power supply positioned within the water compartment and connectable to the bathtub housing.

7. The bathtub of claim 1 wherein the water compartment is separate from the bathtub housing and comprises a plurality of wheels for moving independently of the bathtub housing when removed therefrom.

8. The bathtub of claim 1 further comprising a plurality of jets connected to the pump for starting and ending water supply to the interior of the housing.

9. The bathtub of claim 1, further comprising a telescoping shower post having a stored position within the bathtub housing and a shower position wherein the rod extends upward from the housing.

10. The bathtub of claim 9 further comprising a shower curtain extending generally downwardly from a shower pole connected to the shower post to enclose the interior of the bathtub housing and an area above the bathtub interior.

11. The bathtub of claim 7 wherein the wheels of the bathtub housing and water compartment are movable to selectively lock the bathtub in place.

12. A portable, walk-in type bathtub, comprising:

a bathtub housing defining an interior for bathing and having an entrance for providing access to the interior of the housing;

a door positioned at the entrance of the housing;

a plurality of wheels positioned near the bottom of the housing;

a removable water compartment operably attached to the bathtub housing, the water compartment comprising a first ballast for holding clean water and a second ballast for holding gray water; and a pump operatively connected to the water compartment for pumping water between the bathtub housing and the water compartment;

said bathtub housing and water compartment forming a substantially integral unit when attached such that the housing and compartment movable as a substantially singular unit; and wherein the removable water compartment being the source of clean water for the bathtub such that an external source is not needed.

13. The bathtub of claim 12 further comprising a first pipe system connected to the first ballast of the water compartment, the pump, and ending at the interior of the housing.

14. The bathtub of claim 13 further comprising a second pipe system from the interior of the housing to the second ballast of the water compartment.

15. The bathtub of claim 12 further comprising a water heater positioned between the inner and outer walls of the housing and operably connected to the first ballast of the water compartment.

16. The bathtub of claim 15 further comprising a power supply operably connected to the pump and the water heater.

17. The bathtub of claim 12 wherein the removable water compartment includes a first attachment for attaching the first ballast to the bathtub housing and a second attachment for attaching the second ballast to the housing.

18. A method of providing a bath, comprising:

taking a bathtub housing having an interior;

attaching a removable water compartment to the housing such that the bathtub housing and water compartment forming a substantially integral unit movable as a substantially singular unit, the compartment having a first ballast and a second ballast;

filling the interior of the bathtub housing with water from the first ballast such that the only source of water is the water compartment; and draining water from the interior of the bathtub housing to the second ballast.

19. The method of claim 18 further comprising heating the water from the first ballast with a water heater before filling the interior of the bathtub with the water.

20. The method of claim 18 wherein the bathtub housing further comprises an exterior, with a plurality of wheels attached to the exterior to move the bathtub housing.

* * * * *